US009570213B2

(12) United States Patent
Liang et al.

(10) Patent No.: US 9,570,213 B2
(45) Date of Patent: Feb. 14, 2017

(54) USB CABLE WITH HEAT SEAL PET MYLAR FILM

(71) Applicant: HON HAI PRECISION INDUSTRY CO., LTD., New Taipei (TW)

(72) Inventors: Xin-Guang Liang, Xipu (CN); Shang-Hua Zhao, Renhe (CN); Lu-Yu Chang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 329 days.

(21) Appl. No.: 14/250,395

(22) Filed: Apr. 11, 2014

(65) Prior Publication Data

US 2014/0305675 A1 Oct. 16, 2014

(30) Foreign Application Priority Data

Apr. 11, 2013 (CN) ..... 2013 2 01799309 U

(51) Int. Cl.
*H01B 11/00* (2006.01)
*H01B 7/04* (2006.01)

(52) U.S. Cl.
CPC ..... *H01B 11/00* (2013.01); *H01B 7/04* (2013.01)

(58) Field of Classification Search
None
See application file for complete search history.

(56) References Cited

U.S. PATENT DOCUMENTS 2,446,387 A * 8/1948 Peterson ..... H01B 9/02 174/102 C
2,981,788 A * 4/1961 Bunish ..... H01B 9/028 174/103
3,614,300 A * 10/1971 Wilson ..... H01B 7/182 174/110 R
3,673,315 A * 6/1972 Lasley ..... H01B 9/028 174/107
3,710,007 A * 1/1973 Hoeg ..... H01B 3/30 174/110 AR
3,710,009 A * 1/1973 Hoeg ..... H01B 3/30 174/110 AR
4,449,012 A * 5/1984 Voser ..... H01B 7/1825 174/113 C
4,657,342 A * 4/1987 Bauer ..... G02B 6/4422 174/115

(Continued)

OTHER PUBLICATIONS

Davis, Leroy. "Universal Serial Bus—USB 3.0 Cable Interface." Jan. 2012 or May 2012. interfacebus.com. https://web.archive.org/web/20120504065242/htpp://www.interfacebus.com/usb-cable-diagram-30.html.*

(Continued)

*Primary Examiner* — Chau N Nguyen
*Assistant Examiner* — Muhammed Azam
(74) *Attorney, Agent, or Firm* — Wei Te Chung; Ming Chieh Chang

(57) ABSTRACT

A USB cable (100), comprising: a power wire (1) transferring positive power, a pair of signal wires (2), a metallic braided layer (6) enclosing on the power wire and the signal wires, and an insulative outer jacket (7) surrounding the metallic braided layer. The power wire comprises a metallic inner conductor and an insulative layer surrounding the inner conductor, a mylar film (11) is surrounding on the power wire, and the mylar film is made of Heat Seal PET.

8 Claims, 1 Drawing Sheet

(56) References Cited

U.S. PATENT DOCUMENTS 4,675,474 A * 6/1987 Neuroth ..... H01B 7/046 156/51
4,860,343 A * 8/1989 Zetena, Jr. ..... G06F 13/409 174/34
4,956,523 A * 9/1990 Pawluk ..... H01B 7/223 174/107
5,133,034 A * 7/1992 Arroyo ..... G02B 6/4415 174/23 C
5,216,204 A * 6/1993 Dudek ..... H01B 11/1025 174/102 SC
5,414,217 A * 5/1995 Neuroth ..... H01B 7/2806 174/102 R
5,426,264 A * 6/1995 Livingston ..... H01B 7/046 174/102 R
5,777,273 A * 7/1998 Woody ..... H01B 9/003 174/113 R
6,297,455 B1 * 10/2001 Wijnberg ..... H01B 7/046 174/113 R
6,310,295 B1 * 10/2001 Despard ..... H01B 11/08 174/113 C
6,415,084 B1 * 7/2002 Iwasaki ..... G02B 6/4416 385/101
6,525,271 B2 * 2/2003 Groegl ..... H01B 3/302 174/105 R
7,166,802 B2 * 1/2007 Cusson ..... H01B 7/20 174/105 R
7,208,683 B2 * 4/2007 Clark ..... H01B 11/04 174/110 R
7,208,684 B2 * 4/2007 Fetterolf, Sr. ..... H01B 7/225 174/113 R
7,297,873 B2 * 11/2007 Grogl ..... H01B 7/292 174/113 R
7,309,835 B2 * 12/2007 Morrison ..... H01B 9/02 174/74 R
7,692,099 B2 * 4/2010 Burke ..... H01B 7/06 174/113 C
8,124,875 B2 * 2/2012 Aitken ..... H01B 9/028 174/102 R
8,981,225 B2 * 3/2015 Izawa ..... H02G 3/0406 174/102 D
9,244,240 B2 * 1/2016 Hayashishita ..... G02B 6/4434
9,245,669 B2 * 1/2016 Glew ..... H01B 7/295
2003/0146015 A1 * 8/2003 Tanaka ..... H01B 11/1091 174/117 F
2004/0035603 A1 * 2/2004 Clark ..... H01B 11/04 174/113 R
2009/0056972 A1 * 3/2009 Dlugas ..... H01B 11/1008 174/107
2009/0250238 A1 * 10/2009 Picard ..... H01B 9/028 174/102 R
2009/0255706 A1 * 10/2009 Jiang ..... H01B 1/24 174/102 R
2010/0025072 A1 * 2/2010 Okano ..... H01B 11/1008 174/115
2011/0139485 A1 * 6/2011 Matsuda ..... H01B 11/002 174/102 R
2011/0278043 A1 * 11/2011 Ueda ..... H01B 7/1895 174/115
2012/0048591 A1 * 3/2012 Gareis ..... H01B 7/0823 174/102 R
2012/0227996 A1 * 9/2012 Ardisana, II ..... H01B 7/182 174/34
2012/0279750 A1 * 11/2012 Lund ..... H01B 7/045 174/107
2013/0062093 A1 * 3/2013 Bodziony ..... H01B 7/046 174/107
2013/0264091 A1 10/2013 Watanabe
2014/0008098 A1 * 1/2014 Scaglione ..... H01B 7/18 174/107
2014/0069682 A1 * 3/2014 Golko ..... H01B 13/14 174/102 C

OTHER PUBLICATIONS

Syde. Syde METAL Lightning Cable (5t). Sep. 8, 2016. Amazon. https://www.amazon.com/Syde-METAL-Lightning-Cable-Military-Grade/dp/B01DOEPRQ0.*
ARCTIC. Micro USB 3.0 Cable_USB 3.0 A Male to Micro B Male. ARCTIC. https:// ww.arctic.ac/us_en/micro-usb-3-0-cable.html.*

* cited by examiner

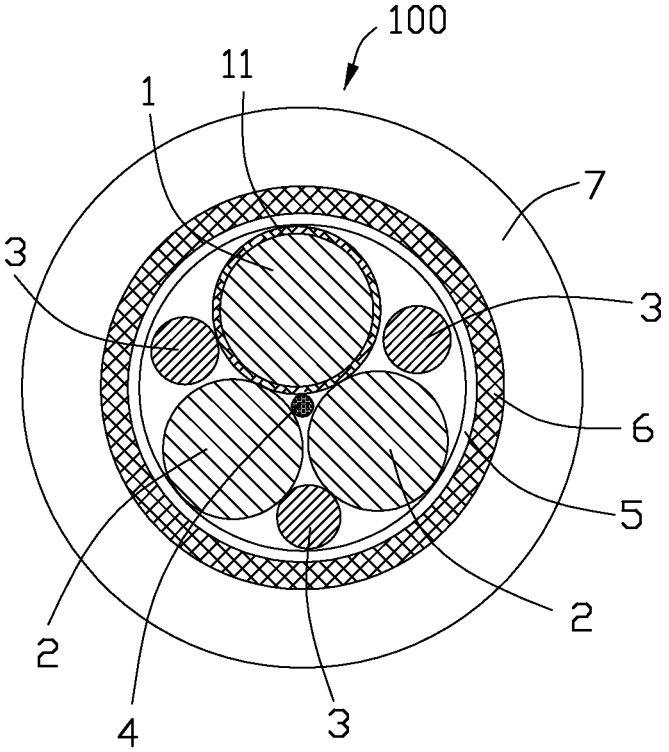
100
11
1
7
3
3
6
5
2
2
4
3

USB CABLE WITH HEAT SEAL PET MYLAR FILM

FIELD OF THE INVENTION

The present invention relates to a cable, and more particularly to a USB (universal serial bus) cable.

DESCRIPTION OF PRIOR ART

Universal Serial Bus, or "USB" is a commonly used term that refers to a standard for connecting two electronic devices or for connecting a device and a host computer. Using USB technology, a plurality of peripherals can be connected using a single standardized interface socket. As of 2006, the USB specification was at version 2.0 (with revisions). The USB 2.0 specification was released in April 2000 and was standardized by the USB-IF at the end of 2001.

According to USB 2.0 specification, a USB cable has four inner wires, including a pair of signal wires transferring D–, D+ signal, the other two wires being power wires. The USB cable is used widely with a function of charging. The power wire of USB cable is required to transfer larger electric current used for peripheral equipments demanding high power, thus the inner wires may have larger external dimensions, though characteristics of small dimension and flexibility of USB cables are determined by specific needs. For meeting a smaller overall dimension while a larger current-carrying conductor, the wire might have a thinner insulating layer, raising concern for safety issue. U.S. Patent Application Publication No. 2012/0227996, to Ardisana, II et al. on Sep. 13, 2012, discloses a cable that can be used as a USB cable, including a conductor bundle, an EMI shield, a braided shield, and a jacket, the conductor bundle can form the core of cable and include one or more conductors for conveying signals and/or power, depending on the desired function of cable.

An improved USB cable is desired.

SUMMARY OF THE INVENTION

Accordingly, an object of the present invention is to provide a USB cable with a smaller overall dimension for power and signal transmission.

In order to achieve the above-mentioned objects, a USB cable comprises a power wire transferring positive power, a pair of signal wires, a metallic braided layer enclosing on the power wire and the signal wires, and an insulative outer jacket surrounding the metallic braided layer. The power wire comprises a metallic inner conductor and an insulative layer surrounding the inner conductor, a mylar film is surrounding on the power wire, and the mylar film is made of Heat Seal PET.

Other objects, features and advantages of the invention will be apparent from the following detailed description taken in connection with the accompanying drawings.

BRIEF DESCRIPTION OF THE DRAWINGS

FIG. 1 is a cross-section view of a USB cable in accordance with the present invention.

DETAILED DESCRIPTION OF PREFERRED EMBODIMENTS

Reference will now be made to the drawing figures to describe the present invention in detail.

Referring to FIG. 1, a cable 100 in accordance with the present invention is a USB (universal serial bus) cable, and comprises a power wire 1 transmitting positive electricity and a pair of signal wires 2 for differential signal transmission. The power wire 1 and the signal wires 2 are extending along an axial direction of the cable 100, and formed a triangle shape in a cross section view of the cable 100 roughly.

The power wire 1 is used for transferring +5v power, the power wire 1 comprises a metallic inner conductor and an insulative layer surrounding the inner conductor, and each signal wire 2 has the same configuration as the power wire 1. The inner conductor is made of copper, and also can be made of aluminum or other selectiveable material. In preferred embodiment, the insulative layer of each of power and signal wires 1, 2 is made of FEP (Fluorinated Ethylene Propylene). The power wire 1 has an external diameter of 25 AWG (American Wire Gauge), and each signal wire 2 has an external diameter of 31 AWG, thus the power wire 1 has a larger dimension than the signal wire 2. A mylar film 11 is enclosing on the power wire 1 to prevent the USB cable being scratched in manufacturing and using, the mylar film 11 is made of Heat Seal PET (Polyethylene Terephthalate). In other embodiments, the mylar film 11 also can be metallic, such as aluminium foil. That is to say, the mylar film 11 covering on the power wire 1 can be metallic or nonmetallic, thus the insulative layer of the power wire 1 can be defined with thinner dimension but without risk of being scratched, thus it's safe in using and the whole dimension of the cable 100 can be decreased.

The cable 100 also comprises a plurality of drain wires 3, a strengthen member 4, a mylar layer 5, a metallic braided layer 6 enclosing on the mylar layer 5, and an insulative outer jacket 7 enclosing on the metallic braided layer 6. In preferred embodiment, the cable 100 includes three drain wires 3, and each drain wire 3 has an external diameter of 32 AWG The three drain wires 3 are mixed up with the power and signal wires 1, 2, and each drain wire 3 is neighboring to two of the power and signal wires 1, 2, the drain wires 3 are arranged with an isosceles triangle in a cross-section view. The metallic braided layer 6 and the drain wires 3 are in a parallel connection relationship for transmitting negative electricity, thus to replace a thick power wire of a conventional USB cable, therefore the number of internal wires of the USB cable can be decreased and the dimension of the whole USB cable is decreased simultaneously.

The strengthen member 4 is located in an axis of the cable 100. The mylar layer 5 is enclosing on the power wire 1, the signal wires 2 and the drain wires 3, and coaxial with the metallic braided layer 6. The metallic braided layer 6 can be of a single layer structure, and also can be of a double layer structure. The external dimension of the cable 100 is less than 3.1 millimeter.

It will be understood that the invention may be embodied in other specific forms without departing from the spirit or central characteristics thereof The present examples and embodiments, therefore, are to be considered in all respects as illustrative and not restrictive, and the invention is not to be limited to the details given herein.

What is claimed is:

1. An electrical cable comprising:

a power wire transferring positive power;

a pair of signal wires intimately contacting the power wire laterally;

three drain wires intermixed with said power wire and said pair of signal wires in an alternate manner;

a metallic braided layer enclosing the power wire and the signal wires and the drain wires; and an insulative outer jacket surrounding the metallic braided layer; wherein the power wire comprises a metallic inner conductor and an insulative layer surrounding the inner conductor, and a reinforcement film surrounds on the power wire;

each of the signal wires is diametrically smaller than the power wire without the reinforcement film thereon;

an axially extending strengthening member is provided at a center surrounded by the power wire and the signal wires;

the strengthening member intimately contacts the power wire and the signal wires while spaced and isolated from the drain wires by said power wire and said signal wires; and a mylar layer is applied upon an interior surface of the braided layer.

2. The electrical cable as claimed in claim 1, wherein in a cross-sectional view the power wire and the pair of signal wires are placed in corners of an imaginary isosceles triangle, and the three draw wires are placed in corners of another imaginary isosceles triangle partially overlapped with the imaginary isosceles triangle in an upside-down manner.

3. The electrical cable as claimed in claim 1, wherein the reinforcement film is a mylar film.

4. The electrical cable as claimed in claim 3, wherein said mylar film is made of Heat Seal PET.

5. The electrical cable as claimed in claim 1, wherein the metallic braided layer and the drain wires are in a parallel connection relationship.

6. The electrical cable as claimed in claim 1, wherein an external dimension of the cable is less than 3.1 millimeter.

7. The electrical cable as claimed in claim 1, wherein the power wire has an external diameter of 25AWG, and each signal wire has an external diameter of 31AWG.

8. The electrical cable as claimed in claim 1, wherein each drain wire has an external diameter of 32AWG.

* * * * *